US012595671B2

(12) United States Patent
Knight et al.

(10) Patent No.: US 12,595,671 B2
(45) Date of Patent: Apr. 7, 2026

(54) SPA FRAME

(71) Applicant: Sundance Spas, Inc., Chino, CA (US)

(72) Inventors: Mark Knight, Venice, CA (US); John Michael Clark, Huntington Beach, CA (US)

(73) Assignee: Sundance Spas, Inc., Chino, CA (US)

( * ) Notice: Subject to any disclaimer, the term of this patent is extended or adjusted under 35 U.S.C. 154(b) by 126 days.

(21) Appl. No.: 18/499,010

(22) Filed: Oct. 31, 2023

(65) Prior Publication Data

US 2024/0141663 A1 May 2, 2024

Related U.S. Application Data

(60) Provisional application No. 63/381,916, filed on Nov. 1, 2022.

(51) Int. Cl.
*E04H 4/00* (2006.01)

(52) U.S. Cl.
CPC ..... *E04H 4/0037* (2013.01)

(58) Field of Classification Search
CPC ..... E04H 4/00–108
See application file for complete search history.

(56) References Cited

U.S. PATENT DOCUMENTS

| | | | |
|---|---|---|---|
| D334,238 | S | 3/1993 | Spedini |
| 5,531,352 | A | 7/1996 | Kraft et al. |
| 5,819,332 | A | 10/1998 | Perry |
| D417,918 | S | 12/1999 | Mussa |
| D420,146 | S | 2/2000 | Mussa |
| D444,565 | S | 7/2001 | Devenish |
| 6,349,427 | B1 | 2/2002 | Bergstrom |
| 6,839,919 | B2 | 1/2005 | Pugliese et al. |
| D559,991 | S | 1/2008 | Dragovich |
| 7,784,120 | B2 | 8/2010 | Spicer |
| D759,833 | S | 6/2016 | Larsen et al. |
| D772,420 | S | 11/2016 | Moir et al. |
| 9,572,459 | B2 | 2/2017 | Dragovic et al. |
| D780,934 | S | 3/2017 | Larsen et al. |
| D898,927 | S | 10/2020 | Qiao |

(Continued)

FOREIGN PATENT DOCUMENTS

| | | | |
|---|---|---|---|
| FR | 3048713 A1 * | 9/2017 | ..... E04H 3/165 |
| NO | 20160463 | 7/2016 | |

(Continued)

OTHER PUBLICATIONS

International Search Report and Written Opinion for Internation Application No. PCT/US2023/036530 dated Feb. 19, 2024.

(Continued)

*Primary Examiner* — Christine J Skubinna
(74) *Attorney, Agent, or Firm* — Knobbe, Martens, Olson & Bear, LLP

(57) ABSTRACT

An adjustable spa frame may include a frame member configured to interface with a sliding frame, the sliding frame configured to be adjusted relative to the frame member to secure the sliding frame at a first position or a second position relative to the frame member. The adjustable spa frame has a first length when the sliding frame is in the first position and the adjustable spa frame has a second length different than the first length when the sliding frame is in the second position.

20 Claims, 11 Drawing Sheets

(56) References Cited

U.S. PATENT DOCUMENTS

| | | | | |
|---|---|---|---|---|
| D975,874 | S | 1/2023 | Painter et al. | |
| D1,014,713 | S | 2/2024 | Wang | |
| 2005/0132487 | A1* | 6/2005 | Layfield | A61H 33/0087 4/541.1 |
| 2008/0289093 | A1 | 11/2008 | Dragovich | |
| 2009/0172873 | A1 | 7/2009 | Ludlow et al. | |
| 2009/0260150 | A1 | 10/2009 | Dragovich et al. | |
| 2021/0017780 | A1* | 1/2021 | Hageman | E04B 1/003 |
| 2021/0355700 | A1 | 11/2021 | Foy et al. | |
| 2021/0381265 | A1* | 12/2021 | Foy | A61H 33/6005 |

FOREIGN PATENT DOCUMENTS

| | | | |
|---|---|---|---|
| WO | WO 2005/060915 | A1 | 7/2005 |
| WO | WO 2018/157033 | A1 | 8/2018 |

OTHER PUBLICATIONS

Classic 770 Frame, online, published date unknown, Retrieved on Apr. 24, 2024 from URL: https://thehottubshop.ca/product/classic-770/.

* cited by examiner

SPA FRAME

CROSS-REFERENCE TO RELATED APPLICATIONS

This application claims the benefit of U.S. Provisional Application No. 63/381,916, entitled "SPA FRAME" and filed on Nov. 1, 2022, which is hereby incorporated by reference herein in its entirety.

TECHNICAL FIELD

The present disclosure generally relates to an adjustable frame for spa units.

BACKGROUND

Spa units or hot tubs may provide many health benefits including stress relief, muscle relaxation, improved sleep, and pain relief, among others.

SUMMARY

Spa units come in different sizes. Typical spa units are manufactured using fixed frames that make it difficult to manufacture spa units of different sizes in a cost effective manner. The present disclosure provides for an adjustable spa frame for manufacturing spa units of different sizes in an efficient and cost effective manner.

According to some embodiments, an adjustable spa frame for a spa unit includes a frame member configured to interface with a sliding frame, the sliding frame configured to be adjusted relative to the frame member to secure the sliding frame at a first position or a second position relative to the frame member. The adjustable spa frame can have a first length when the sliding frame is in the first position. The adjustable spa frame can have a second length different than the first length when the sliding frame is in the second position.

A variation of the aspect above is, wherein the sliding frame is configured to slide relative to the frame member.

A variation of the aspect above is, wherein the frame member is configured to receive the sliding frame, or vice versa.

A variation of the aspect above is, wherein the adjustable spa frame further includes a second frame member configured to interface with a second sliding frame.

A variation of the aspect above is, wherein the second frame member and the second sliding frame are arranged parallel to the frame member and the sliding frame.

A variation of the aspect above is, wherein the second frame member is configured to be non-adjustably secured to the sliding frame.

A variation of the aspect above is, wherein the second sliding frame is arranged perpendicular to the sliding frame.

A variation of the aspect above is, wherein the frame member forms a corner of the adjustable spa frame.

A variation of the aspect above is, wherein the frame member includes a top rail and a bottom rail, the top rail configured to receive a top arm of the sliding frame and the bottom rail configured to receive a bottom arm of the sliding frame.

A variation of the aspect above is, wherein sliding frame configured to be secured to the frame member at a third position.

A variation of the aspect above is, wherein the adjustable spa frame includes four frame members and four sliding frames.

A variation of the aspect above is, wherein the frame member includes a rounded region and a flat surface.

A variation of the aspect above is, wherein the frame member includes a rounded region and a flat surface.

A variation of the aspect above is, wherein the adjustable spa frame includes a plurality of projections extending from the frame member.

A variation of the aspect above is, wherein the adjustable spa frame includes a plurality of ports in the sliding frame, each of the plurality of ports configured to receive and secure each of the plurality of projections.

A variation of the aspect above is, wherein the adjustable spa frame includes a plurality of panels, each panel of the plurality of panels configured to be mounted to a side of the spa.

A variation of the aspect above is, wherein each panel of the plurality of panels includes rounded a first portion comprising a flat surface and a second portion comprising a rounded surface.

A variation of the aspect above is, wherein the adjustable spa frame comprises a first fixed frame member and a second fixed frame member, the first fixed frame member configured to be secured to at least one of the frame member and the sliding frame and the second fixed frame member configured to be secured to the other of the frame member and the sliding frame.

According to some embodiments, an adjustable spa frame configured to receive a spa shell can include a plurality of frame members. Each frame of the plurality of frame members can include a top rail and a bottom rail. The adjustable spa frame can include a plurality of sliding frames. Each of the plurality of sliding frames can include a top arm and a bottom arm. The top rail of each of the plurality of frame members can be configured to receive the top arm of one of the plurality of sliding frames. The bottom rail of each of the plurality of frame members can be configured to receive the bottom arm of one of the plurality of sliding frames. A length of one frame member and one sliding frame when the one frame member and the one sliding frame are secured to each other can be configured to be adjusted by sliding the one sliding frame from a first position to a second position.

A variation of the aspect above is, wherein the length of the one frame member and the one sliding frame is adjustable by at least 10 inches.

A variation of the aspect above is, wherein the adjustable spa frame further includes a plurality of bumpers configured to be removably connected to the plurality of frame members, the plurality of bumpers forming rounded corners of the spa frame.

A variation of the aspect above is, wherein the plurality of frame members further includes a plurality of openings including a first opening and a second opening in the top rail or the bottom rail.

A variation of the aspect above is, wherein the plurality of sliding frames further includes a push button configured to secure one of the plurality of sliding frames to one of the plurality of frame members by at least partially extending through at least one of the first and second openings.

A variation of the aspect above is, wherein the plurality of openings further include a third opening and a fourth opening.

A variation of the aspect above is, wherein the plurality of frame members further includes a plurality of visual markers including a first visual marker and a second visual marker.

A variation of the aspect above is, wherein the plurality of visual markers are located adjacent to a plurality of openings of the plurality of frame members and provide an indication of the length of the one frame member and the one sliding frame when the one frame member and the one sliding frame are secured to each other.

A variation of the aspect above is, wherein the plurality of visual markers further include a third visual marker and a fourth visual marker.

A variation of the aspect above is, wherein the plurality of frame members and the plurality of sliding frames form a quadrilateral shape when the plurality of frame members are secured to the plurality of sliding frames.

A variation of the aspect above is, wherein the adjustable spa frame further includes a kick rail positioned on a ground facing area of the spa frame. The kick rail can be configured to secure to at least one of a shallow pan and a deep pan.

A variation of the aspect above is, wherein a top edge of the spa frame can be configured to receive and secure a shell trim.

A variation of the aspect above is, wherein the length of the of the one frame member and the one sliding frame when the one frame member and the one sliding frame are secured to each other is between about 60 inches to about 100 inches.

A variation of the aspect above is, wherein the length of the of the one frame member and the one sliding frame when the one frame member and the one sliding frame are secured to each other is between about 65 inches to about 95 inches.

A variation of the aspect above is, wherein the length of the of the one frame member and the one sliding frame when the one frame member and the one sliding frame are secured to each other is between about 69 inches to about 89 inches.

According to some embodiments, an adjustable spa frame for a spa unit can include a frame member including a top rail and a bottom rail; and a sliding frame including a first arm and a second arm. The top rail of the frame member can be configured to receive and secure the first arm of the sliding frame. The bottom rail of the frame member can be configured to receive and secure the second arm of the sliding frame. The sliding frame can be configured to be adjusted between at least a first position and second position when the sliding frame is secured to the frame member. The adjustable spa frame can have a first length when the sliding frame is in the first position. The adjustable spa frame can have a second length different than the first length when the sliding frame is in the second position.

A variation of the aspect above is, the techniques described herein relate to an adjustable spa frame, wherein: at least one of the top rail and the bottom rail includes a first opening and a second opening; at least one of the first arm and the second arm includes a button; wherein the first and second openings are configured to receive and secure the button.

A variation of the aspect above is, wherein the sliding frame is in the first position when the button is secured to the first opening, and wherein the sliding frame is in the second position when the button is secured to the second opening.

A variation of the aspect above is, wherein the adjustable spa frame further including a plurality of visual markers located adjacent to the first and second openings, the plurality includes visual markers configured to provide an indication of a length of the adjustable spa frame.

A variation of the aspect above is, wherein the second length is greater than the first length by at least 4 inches.

A variation of the aspect above is, wherein the adjustable spa frame further includes a bumper configured to be removably connected to the frame member, the bumper forming a rounded corner of the spa frame.

A variation of the aspect above is, the adjustable spa frame further includes a second frame member secured to the sliding member; and a second sliding member secured to the frame member. The second frame member and the second sliding member can be substantially perpendicular to the frame member and the sliding member.

A variation of the aspect above is, wherein a top edge along the frame member and the sliding member is configured to receive and secure at least a portion of a shell trim.

A variation of the aspect above is, wherein the first length is between about 65 inches to about 85 inches.

A variation of the aspect above is, wherein the first length is between about 69 inches to about 84 inches.

A variation of the aspect above is, wherein the second length is between about 75 inches to about 90 inches.

A variation of the aspect above is, wherein the second length is between about 80 inches to about 89 inches.

DETAILED DESCRIPTION

Spa frames for a spa unit, spa shell, or other water basin are described herein. At least some of the spa frames described herein include sliding or otherwise adjustable components for adjusting the dimensions of the spa frame. The adjustable spa frame can be used with different sized spa shells and reduce the number of different sized spa frames that need to be carried in inventory.

Figure 1:
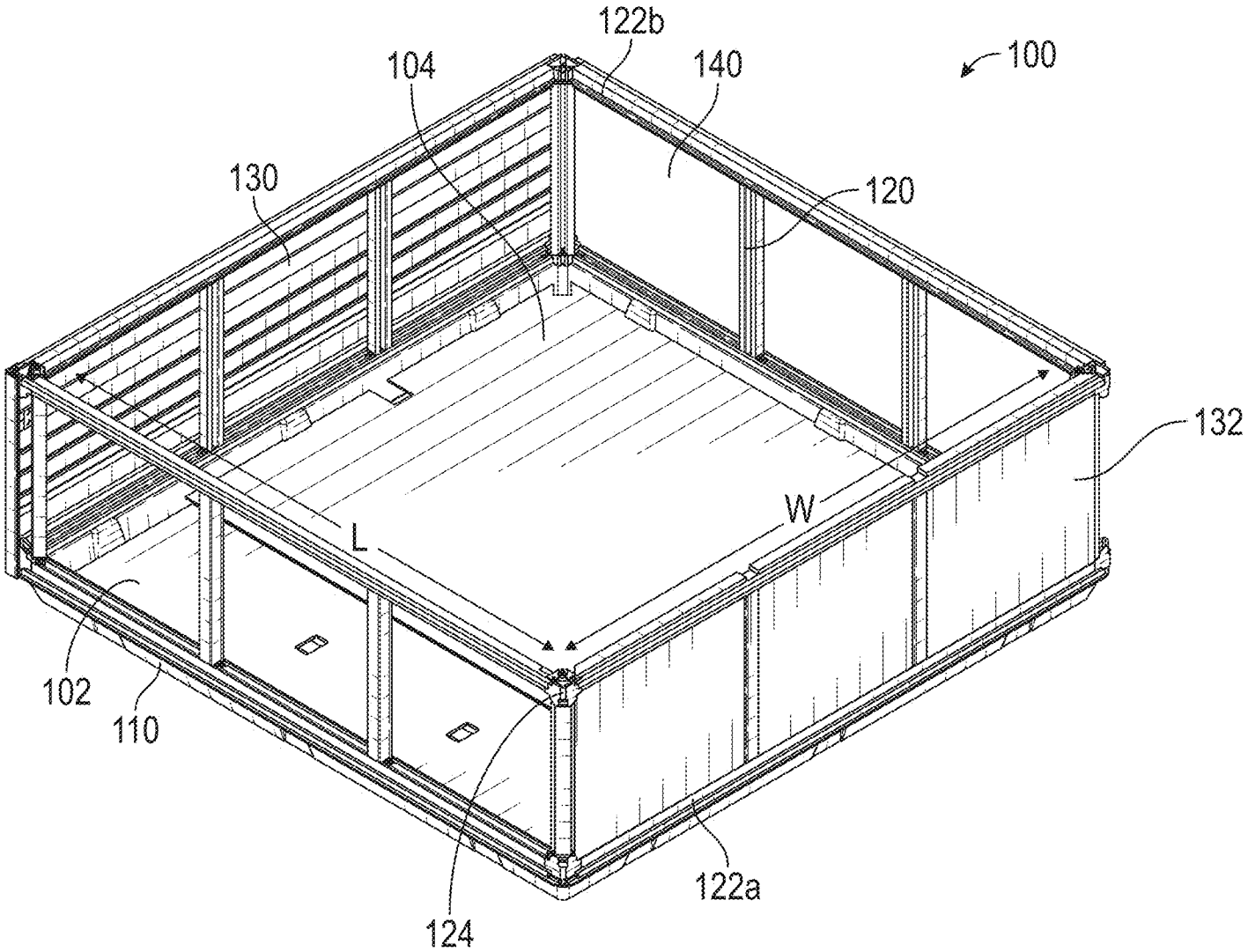
FIGS. 1-2 show an example of a frame for a spa unit.
Figure 2:
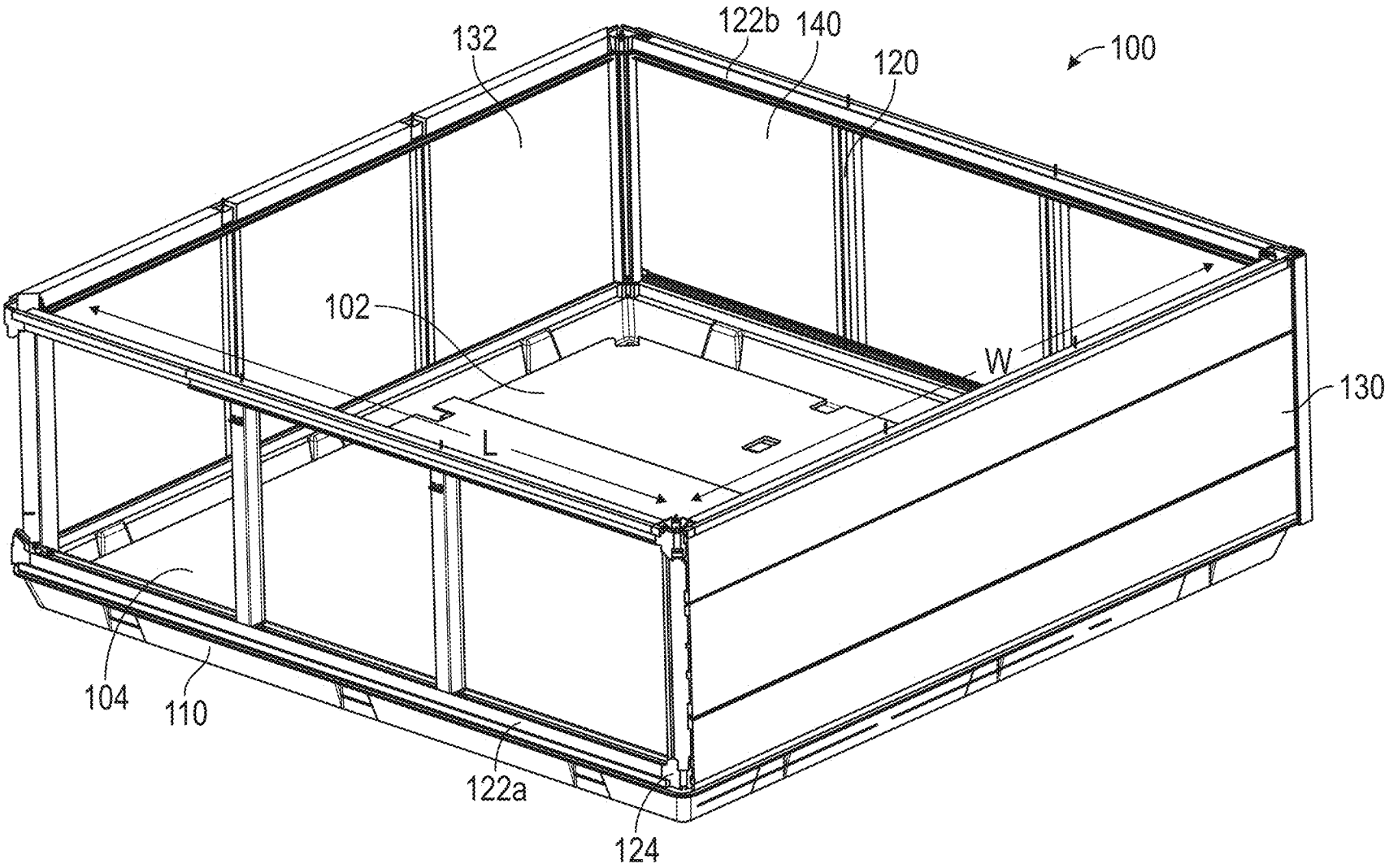

In comes cases, and as shown in FIGS. 1 and 2, the spa frame 100 can include a base 110, a plurality of support structures, and a plurality of panels. The spa frame 100 can include a first plurality of support structures 120. The plurality support structures can include weight resistant, yet light, materials such as aluminum. In some cases, the plurality of support structures 120 can be fabricated by injection molding.

In FIGS. 1 and 2, the first plurality of support structures 120 can extend from an upper edge to a lower edge of the spa frame 100. For example, the spa frame 100 can include one or more support structures 120 on each side of the spa frame, e.g., three or four support structures on each side of the spa frame. As illustrated, the spa frame 100 can include twelve support structures 120 but may include fewer or more than illustrated. The first plurality of support structures 120 can be attached to a second plurality of support structures 122*a* on one end and to a third plurality of support structures 122*b* on the other end. In FIGS. 1 and 2, the second and third plurality of support structures 122*a*, 122*b* include four structures each, one on each side of the spa frame. The second and third plurality of support structures can include more or less than four support structures each. The second plurality of support structures 122*a* can be attached to the base 110 of the spa frame 100. A plurality of connectors 124 can facilitate attachment of the first, second, and third plurality of support structures 120, 122*a*, 122*b* to each other. For example, the spa frame 100 can include a plurality of connectors 124 positioned on the spa frame's 100 upper and lower corners, as shown in FIGS. 1 and 2. In some cases, the plurality of connectors 124 can be fabricated by injection molding.

The spa frame 100 can include a plurality of apertures 140 along the sides of the spa frame 100. The plurality of apertures 140 can be formed by the first, second, and third plurality of support structures 120, 122*a*, 122*b*, as shown in FIGS. 1 and 2. In some cases, the spa frame 100 can include twelve apertures 140. The spa frame 100 can include more than or less than twelve apertures 140. As shown in FIGS. 1 and 2, one or more sides of the spa frame 100 can include a first plurality of panels 130 and/or a second plurality of panels 132. The first plurality of panels 130 can include an extruded material, such as an extruded polysterene. In some cases, the first plurality of panels 130 can be positioned substantially perpendicular to the first plurality of support structures 120. The first plurality of panels 130 can extend a width W of the spa frame 100. In some cases, and as shown in FIGS. 1 and 2, the first plurality of panels 130 can include one or more panels stacked along at least one side of the spa frame 100. The second plurality of panels 132 can cover a plurality of apertures 140 formed by the first, second, and third plurality of support structures 120, 122*a*, 122*b* on the opposite side of the spa frame. As illustrated, each of the plurality of panels 132 can fit within a respective aperture 140. The second plurality of panels 132 may be foam boards, which can beneficially provide insulation. Although FIGS. 1 and 2 show the first and second plurality of panels 130, 132 covering only two sides of the spa frame 100, the first and/or second plurality of panels 130, 132 can cover all sides of the spa frame 100. For example, the spa frame can include the first plurality of panels 130 on one or more sides, the second plurality of panels 132 on one or more sides, or a combination thereof on one or more sides (e.g., the first plurality of panels 130 on two sides and the second plurality of panels 132 on two sides). The spa frame 100 can receive a spa shell (not shown). The spa frame 100 and any of its components can include extruded and/or injection molded materials.

A floor on the interior of the spa frame 100 can include two different sections having two different materials. A first region 102 can be dedicated to the equipment pack and a second region 104 can be dedicated to the spa shell. The first region 102 can include a PVC material and the second region 104 can include a mesh material.

Figure 3:
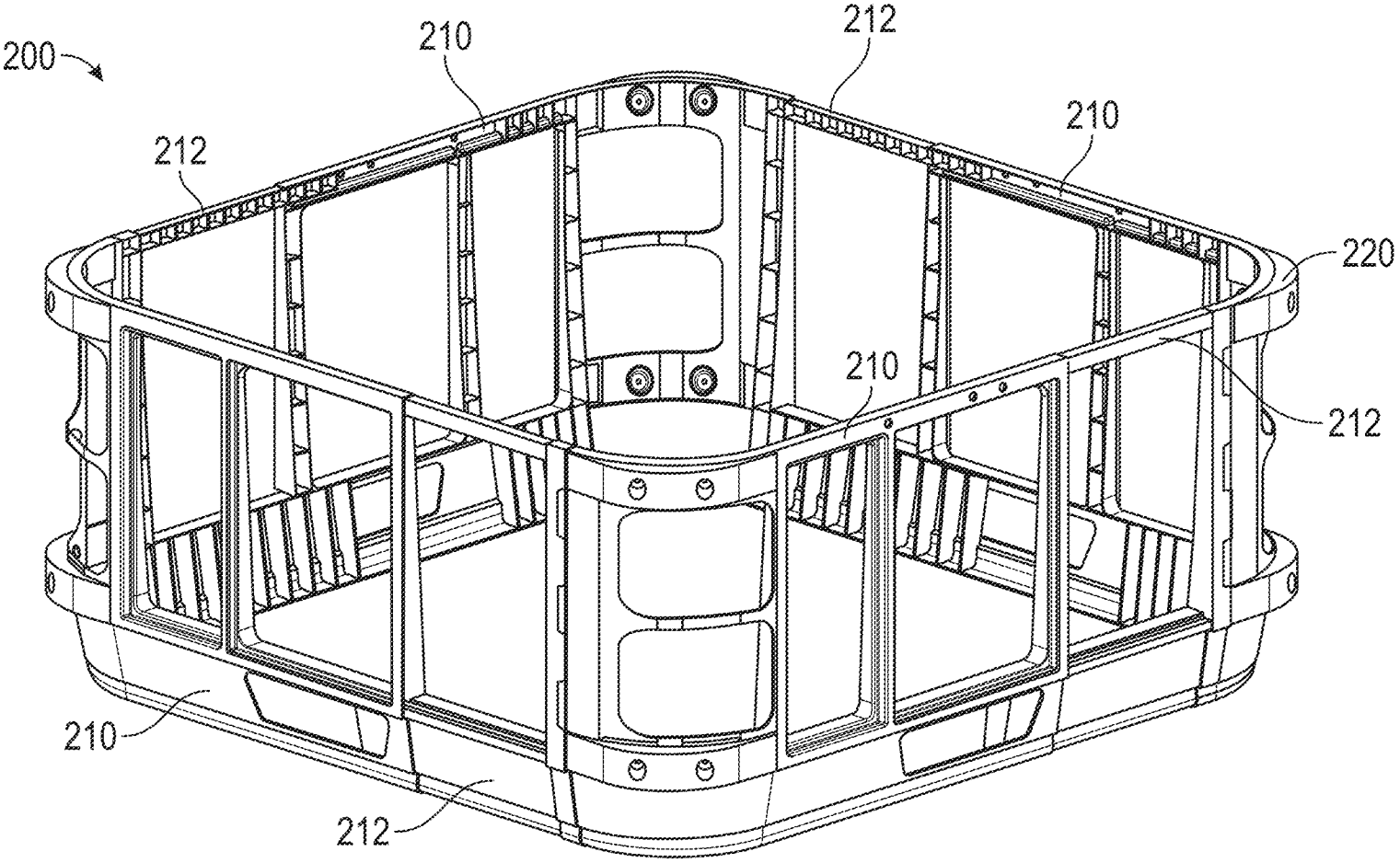
FIG. 3 shows an example of a frame for a spa unit.

FIG. 3 illustrates another spa frame 200. The spa frame 200 can include one or more frame members 210, one or more sliding frames 212 (also referred herein to as sliding members), and/or one or more bumpers 220. As illustrated, each side of the spa frame 200 can include a frame member 210 and a sliding frame 212. This allows both the length and the width of the spa frame 200 to be adjusted. Each sliding frame 212 can connect two adjacent frame members 210. In other implementations, the spa frame 200 may only include sliding frames 212 on two parallel sides of the spa unit, such that only the length or the width of the spa frame 200 is adjustable.

Each of the one or more frame members 210 may include a rounded region forming a corner of the spa frame. Each frame member 210 can interface with at least one sliding frame 212. For instance, each sliding frame 212 can be configured to slide relative to a frame member 210. Each frame member 210 can be configured to receive at least one sliding frame 212, or vice versa. Each frame member 210 can be fixedly connected to a first sliding frame 212 on one side, e.g., by an interlocking connection, and slidably connected to a second sliding frame 212 on the other side. In other implementations, the frame member 210 may be slidably connected to the first sliding frame and the second sliding frame.

In other configurations, each sliding frame 212 may receive at least one frame member 210. Each sliding frame 212 can be fixedly connected to a first frame member 210 on one side, e.g., by an interlocking connection, and slidably connected to a second frame member 210 on the other side.

Figure 6:
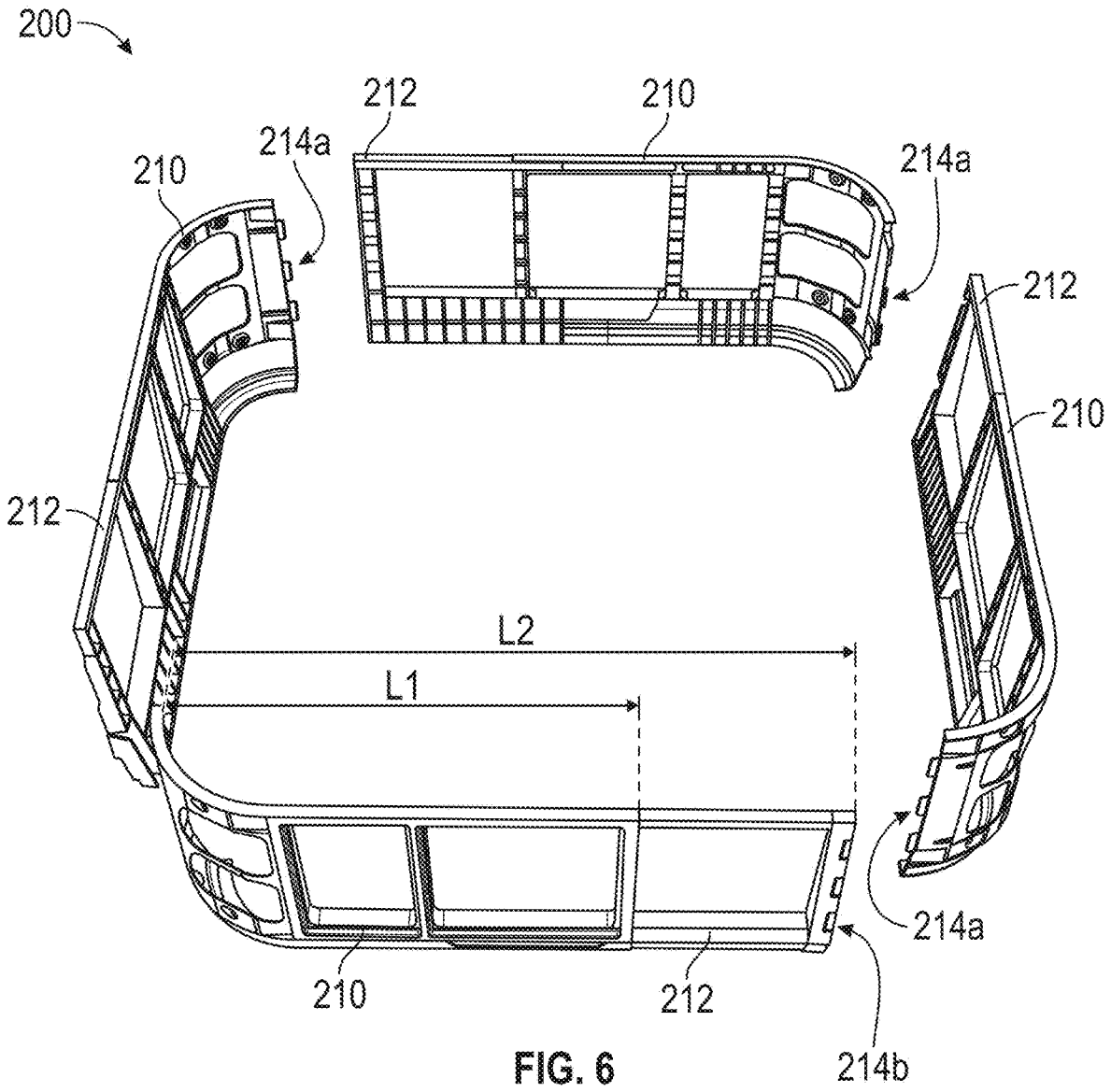
FIG. 6 shows an exploded view of the frame shown in FIG. 3.

A sliding frame 212 can slide along a length L1, as shown in FIG. 6, of a frame member 210. Beneficially, this permits the length L2, as shown in FIG. 6, of frame member 210 and the sliding frame 212 when coupled to each other to be adjusted.

Figure 4:
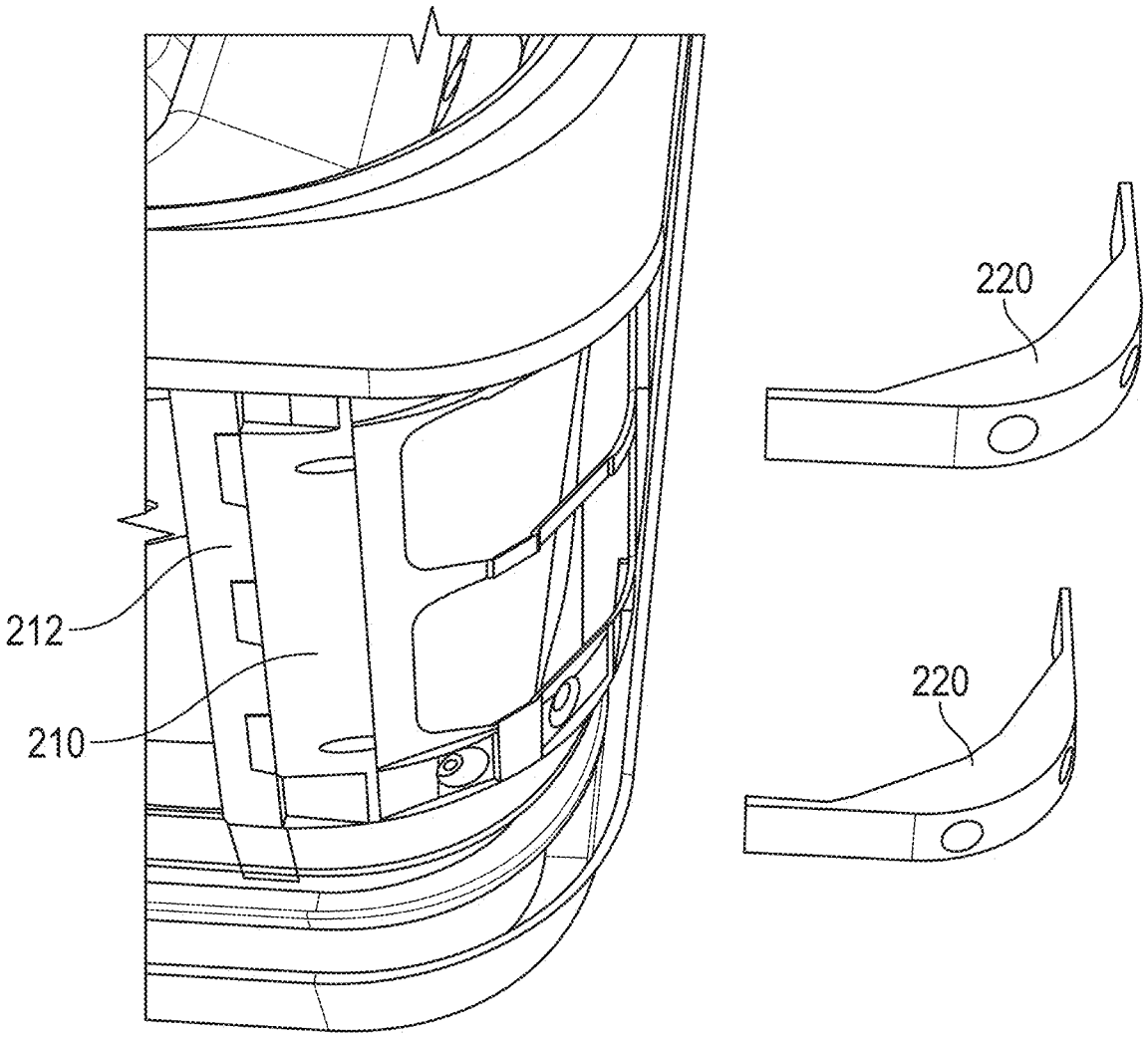
FIG. 4 shows examples of bumpers which can be attached to a spa frame.
Figure 5:
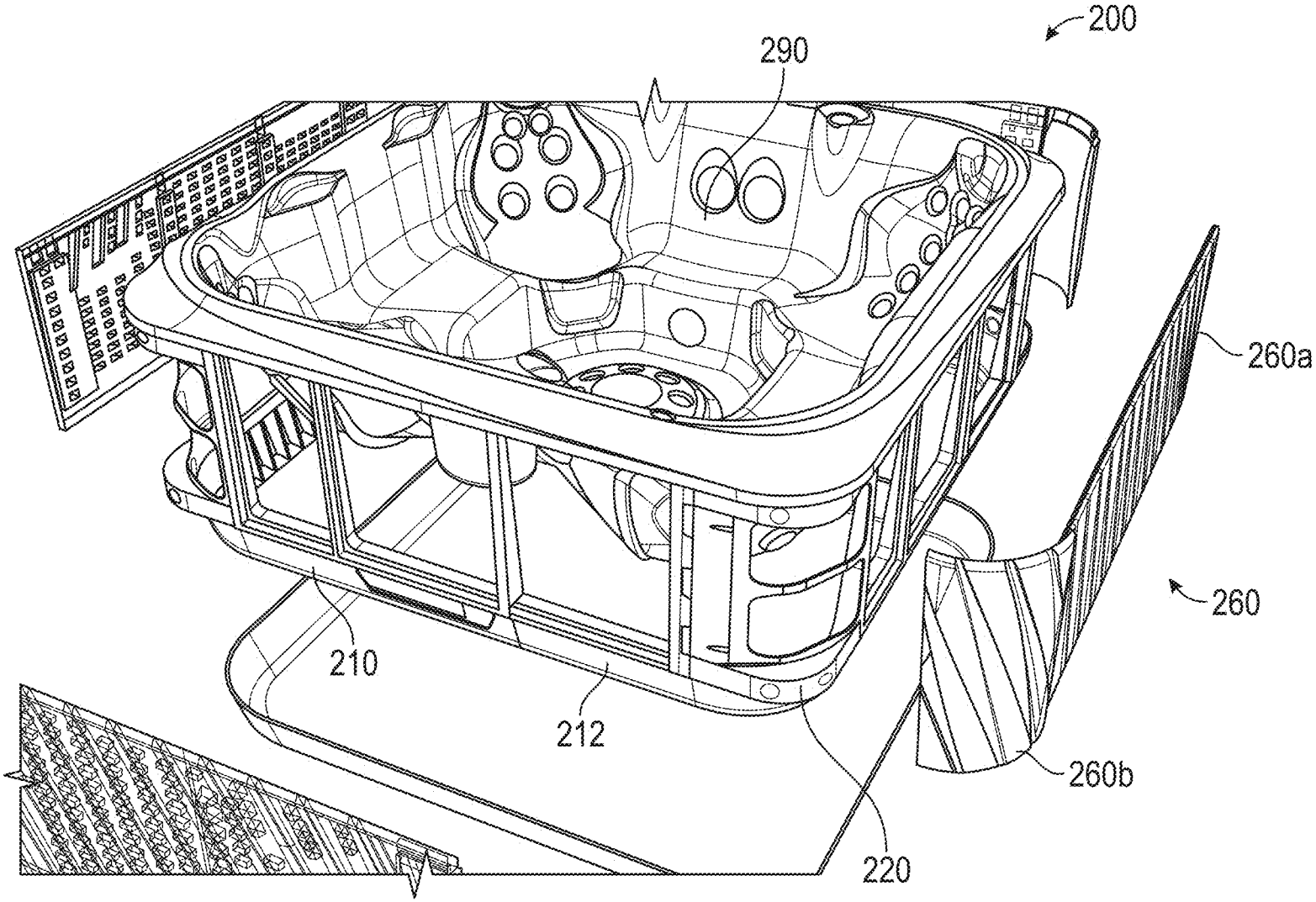
FIG. 5 shows an example of a spa shell secured to the frame shown in FIG. 3.

The one or more bumpers 220 can be secured to each of the one or more frame members 210. For example, each bumper 220 can be attached one of the frame members 210 around the corners of the spa frame 200, as shown in FIGS. 3-5. In some embodiments, the each frame member 210 can connect to one or more of a number of different sized bumpers 220. The different sized bumpers 220 create corners of the spa frame 200 and can form a semi-circular shape having a radius ranging from about 8 in. to 15 in. In some cases, the bumpers can be attached to the spa frame 100 using one or more bolts. In some implementations, the bumpers 220 can be made out of a blow moulding process.

As shown in FIG. 5, when the spa frame 200 is assembled, it can receive a spa shell 290. A layer of foam can be applied to the exterior portions of the spa frame 200. Because the length L2 of a frame member 210 and a sliding frame 212 when they are secured to each other can be adjusted, the overall dimensions of the spa frame 200 can be adjusted too. Beneficially, the dimensions of the spa frame 200 can be adjusted to receive spa shells, such as spa shell 290, of different sizes. A plurality of panels 260 can be mounted to the sides of the spa frame 200. Each of the plurality of panels 260 can include a first portion 260*a* and a second portion 260*b*. The first portion 260*a* can include a flat surface which can be secured to a side of the spa frame 200. The second portion 260*b* can include a rounded surface which can be secured to a corner of the spa frame 200. As will be described further below, the spa frame 200 can be mounted on top of a pan.

As shown in FIG. 6, of the one or more frame members 210 can include four frame members and the one or more sliding frames 212 can include four sliding frames. One end of a frame member 210 can receive one end of a sliding frame 212, or vice versa. The other end of the frame member 210 can be attached to another sliding frame 212.

Although reference is made to each side of the spa frame 200 having a frame member 210 and a sliding frame 212, in some cases only a subset of the spa frame 200 sides include a frame member 210 and a sliding frame 212. For example, a first pair of parallel sides of the spa frame 200 can each include a frame member 210 and a sliding frame 212. The second pair of parallel sides of the spa frame 200 may not include both a frame member 210 and a sliding frame 212 and may instead include a pair of fixed frame members (e.g., a pair of frame members 210 or a pair of sliding frames 212). For example, the adjustable spa frame 200 can include a first fixed member and a second fixed frame member each secured to a frame member 210 and a sliding frame 212. The fixed frame members of the second pair of parallel sides can each be secured to a frame member 210 and/or a sliding frame 212 of the first pair of parallel sides. Where only two sides of the spa frame 200 each include a frame member 210 and a sliding frame 212, the length of the spa frame 200 may be adjusted by adjusting the position of the sliding frames 212 relative to the frame members 210, or vice versa.

As previously discussed, each frame member 210 can be secured to a sliding frame 212 with an interlocking connection. The interlocking connection can include one or more projections 214*a* extending from the frame member 210 that can be received and/or secured by one or more ports 214*b* along a corresponding sliding frame 212, or vice versa. The spa frame 200 can be assembled by securing each frame member 210, for example four frame members 210, to a pair of sliding frames 212. To disassemble the spa frame 200, one end of each frame member 210 may be detached from a sliding frame 212 by releasing the projections 214*a* from the ports 214*b*, and each sliding frame 212 may be removed from a frame member 210 by sliding the sliding frame 212 out of the frame member 210. The ability to disassemble the spa frame 200 can allow the components of the spa frame 200, including the frame members 210 and the sliding frames 212, to be packed, stored, and/or transported individually which may beneficially result in decreased packaging, transportation, and/or storage costs.

Figure 7:
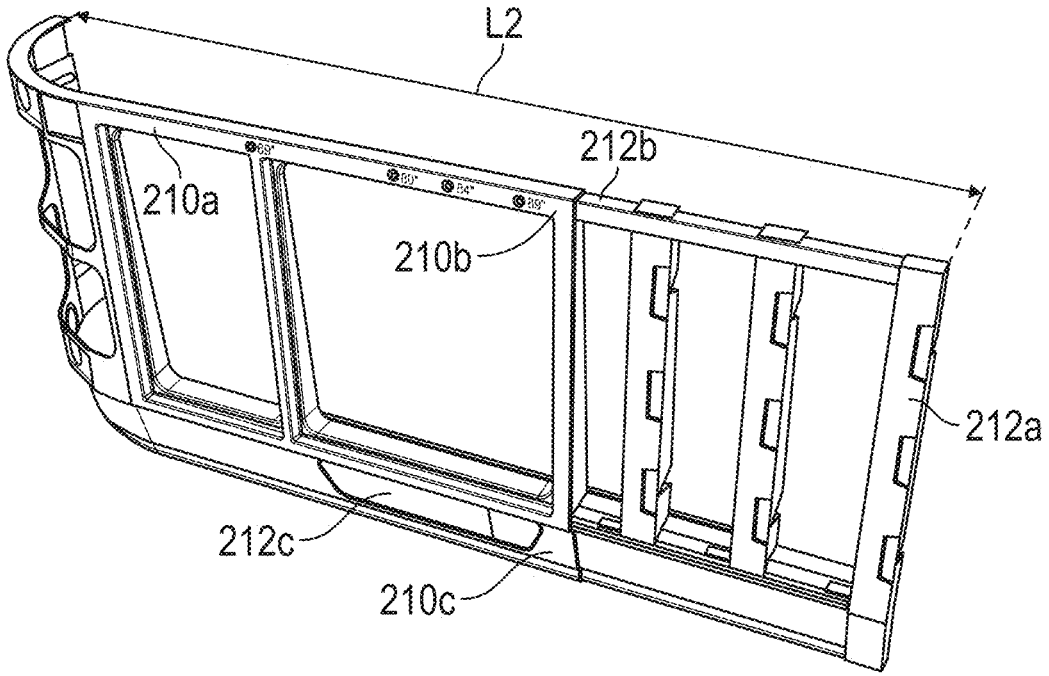
FIG. 7 shows examples of a frame member and a sliding frame of the frame shown in FIG. 3.
Figure 8:
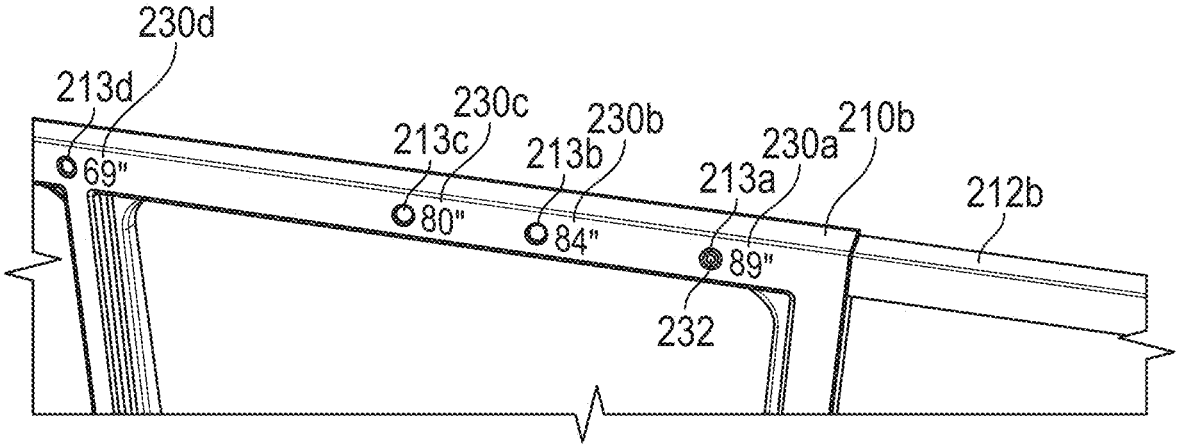
FIG. 8 shows a frame member having a plurality of apertures and visual markers.

FIGS. 7 and 8 illustrate how a sliding frame 212 can slide through a frame member 210. For example, the sliding frame 212*a* can include a top arm 212*b* and a bottom arm 212*c* that can be received by a top rail 210*b* and a bottom rail 210*c* of a frame member 210*a*. The position of the top and bottom arms 212*b*, 212*c* along the top and bottom rails 210*b*, 210*c* can be adjusted to enlarge or shorten the total length L2 of the frame member 210*a* and the sliding frame 212*a* when they are coupled to each other. In some cases, the length L2 of each pair of frame member and sliding frame can be changed across a distance of at least 4 inches, at least 5 inches, at least 9 inches, at least 10 inches, at least 11 inches, at least 15 inches, or at least 20 inches, for example from around 69 in. to around 89 in. and values therebetween, for example 80 inches and 84 inches. In some cases, the length L2 can be between about 60 inches and about 100 inches, between about 65 inches and about 95 inches, and/or between about 70 inches and about 90 inches.

The length L2 can be adjusted between two or more positions, for example at least two positions, at least three positions, at least four positions, or more. For example, the frame member 210 can include at least four positions, as shown in FIG. 7, for adjusting the length L2 of a frame member 210 and a sliding frame 212 when they are secured to each other. The length L2 may be changed at regular or varying intervals of at least 4 inches, at least 5 inches, at least 9 inches, at least 10 inches, at least 11 inches, at least 15 inches, or at least 20 inches. The length of each pair of frame members 210 and sliding frames 212 can be adjusted independently. Thus, the spa frame 200 can be adjusted to receive spa shells 29 with dimensions ranging from about 69 in×69 in to about 89 in×89 in. Although reference is made to the length L2 being adjustable between about 69 in. to about 89 in., the length L2 of each pair of frame members 210 and sliding frames 212 can be adjusted so the length L2 is less than 69 in. and/or more than 89 in.

Where only two sides of the spa frame 200 each include a frame member 210 and a sliding frame 212, the non-adjustable sides can include a fixed length while the adjustable sides can include an adjustable length ranging from about 69 in. to about 89 in.

After the sliding frame 212 and the frame member 210 are adjusted to a desired length, the sliding frame 212 and the frame member 210 can be locked in the desired position. In some cases, top rail 210*b* and/or the bottom rail 210*c* can include one or more visual markers. For example, the top rail 210*b* of the frame member 210*a* can include one or more visual markers, as shown in FIGS. 7-8. The visual markers, along with a push button 232 of the sliding frame 212*a*, can provide an indication of the length L2. For example, the push button 232 of the sliding frame 212*a* can help secure the sliding frame 212 into place and provide an indication of the length L2. The push button 232 can at least partially extend through one of a plurality of openings in the top rail 210*b*. Each visual marker can be associated to one of the plurality of openings. A push button 232 extending through a particular opening can provide an indication of the current length L2. For example, as shown in FIG. 8, push button 232 can extend through the opening 213*a* associated to the visual marker 230*a* and provide an indication that the total length L2 of the frame member 210*a* and the sliding frame 212*a* is 89 in. The length L2 can be adjusted to, for example 84 in, by pushing the push button 232 and sliding the sliding frame 212*a* toward the opening 213*b* associated to the visual marker 230*b*. Once the push button 232 reaches the location of the opening 213*b* associated to visual marker 230*b*, the push button 232 can extend at least partially through the opening 213*b* therefore securing the sliding frame 212*a* in place.

The sliding frame 212*a* can be adjusted by advancing or retracting the sliding frame 212*a* as described above. The top rail 210*b* can include a visual marker for each length arrangement. For example, a visual marker 230*c* can indicate a length L2 of 80 in, while a visual marker 230*d* can indicate a length L2 of 69 in. Similarly, the top rail 210*b* can include an opening for each length arrangement. For example, an opening 213*c* can indicate a length L2 of 80 in, while an opening 213*d* can indicate a length L2 of 69 in. Each frame member 210 can include more than or less than four visual markers and openings for adjusting the length L2 and for providing an indication of such length L2. The position of the openings along the top rail 210*b* can be adjusted to allow the L2 of the spa frame 200 to measure between around 69 in. to around 89 in. In some cases, the position of the openings along the top rail 210*b* can be adjusted to allow the L2 of the spa frame 200 to measure between around 84 in. to around 91 in.

Figure 9A:
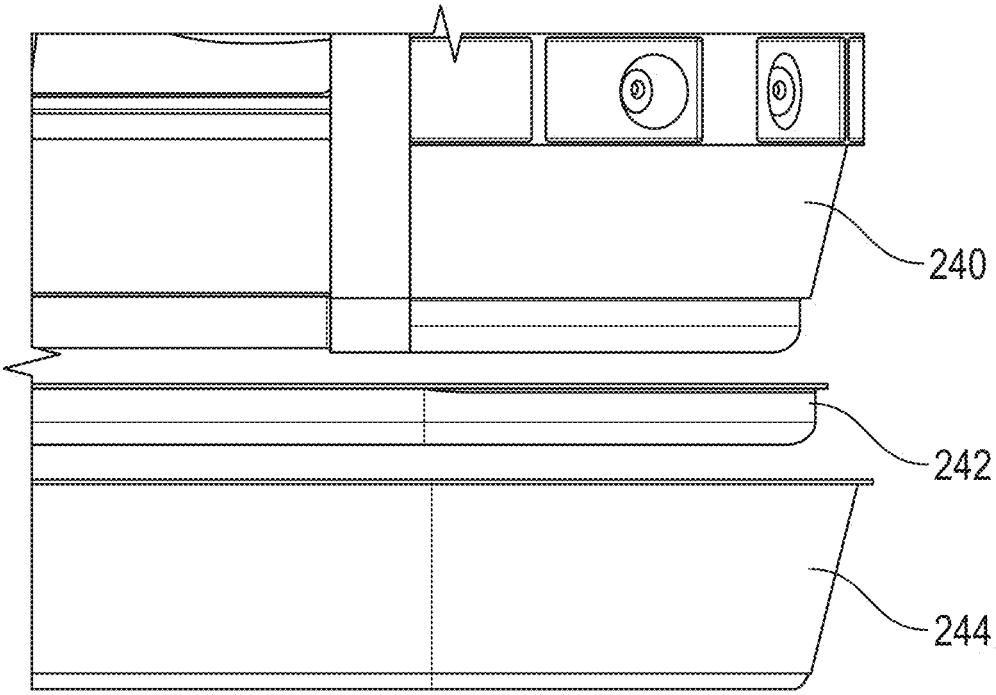
FIG. 9A shows an exploded view of a kick rail, a shallow pan, and a deep pan for a frame.
Figure 9C:
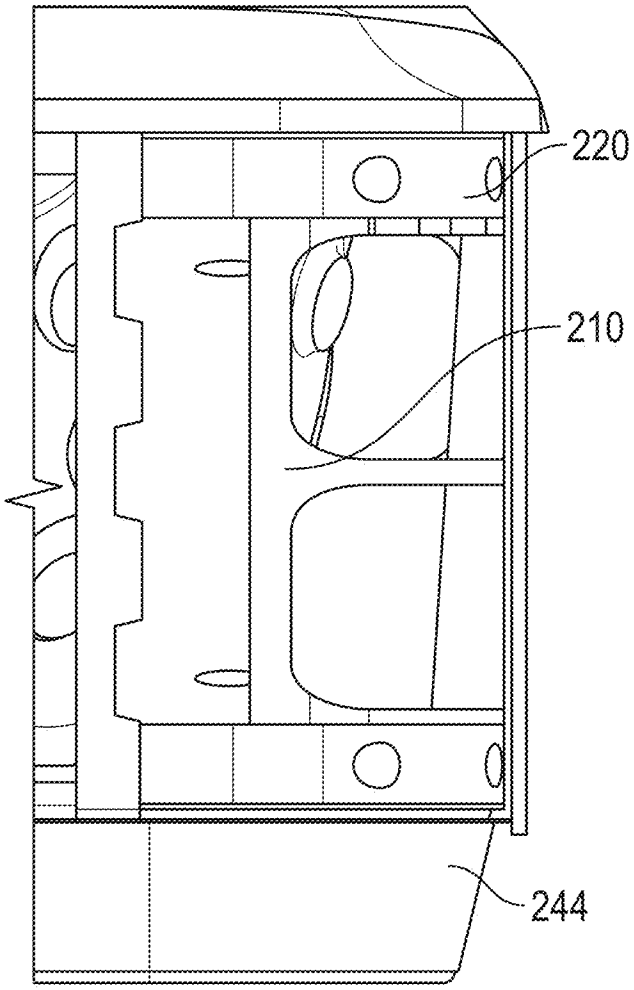
FIG. 9C shows an example of a kick rail secured to a deep pan.
Figure 9B:
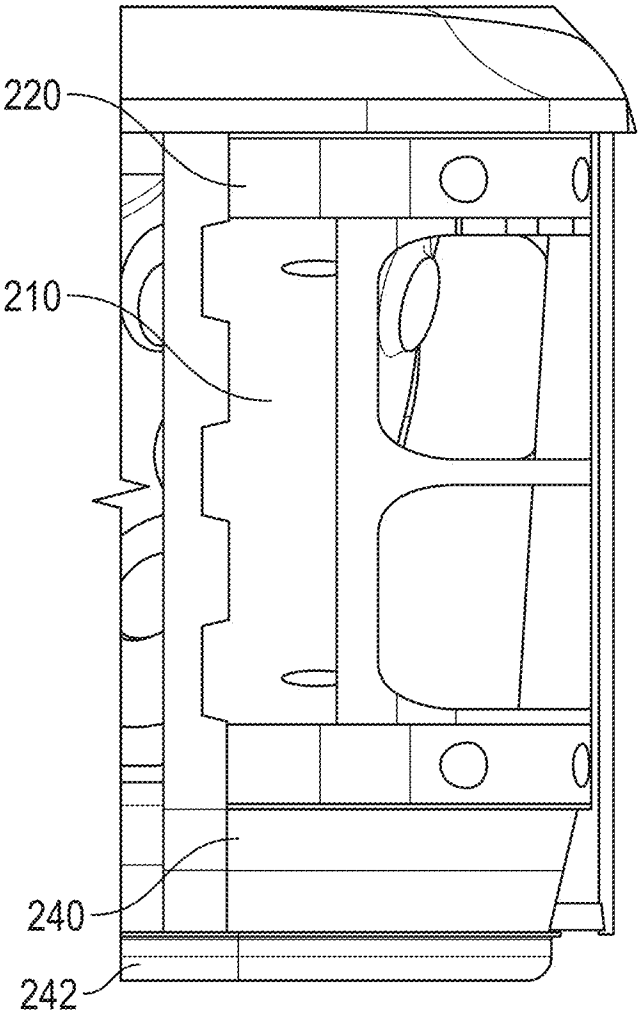
FIG. 9B shows an example of a kick rail secured to a shallow pan.

The spa frame 200 can also include a kick rail 240, a shallow pan 242, and/or a deep pan 244, as shown in FIG. 9A. The kick rail 240 may be made up of components integral with the frame members 210 and/or sliding frames 212. The kick rail 240 can beneficially protect the structure of the spa frame 200 from hits. In some cases, at least a portion of the kick rail 240 of the spa frame 200 can sit on the shallow pan 242 which in turn can sit on the deep pan 242. In some cases, the kick rail 240 sits on the shallow pan 242, as shown in FIG. 9B. In some cases, the kick rail 240 sits on the both the shallow pan 242 and the deep pan 244, as shown in FIG. 9C. The shallow pan 242 and/or the deep pan 244 can beneficially prevent the spa frame 200 from resting directly on the ground which can damage the structure of the spa frame 200. The shallow pan 242 and/or the deep pan 244 can also prevent liquids (e.g., leaks) from spilling onto the exterior of the spa frame 200 by maintaining the liquids in the shallow pan 242 and/or the deep pan 244.

Figure 10A:
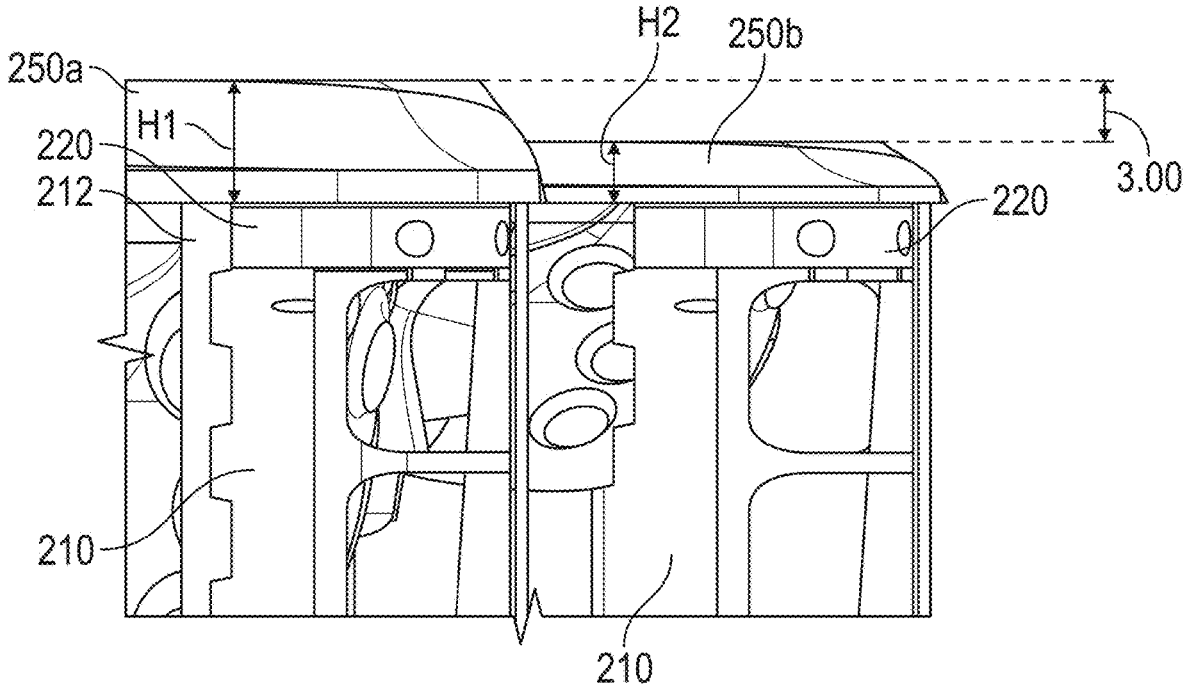
FIG. 10A shows examples of shell trims secured to a spa frame.
Figure 10B:
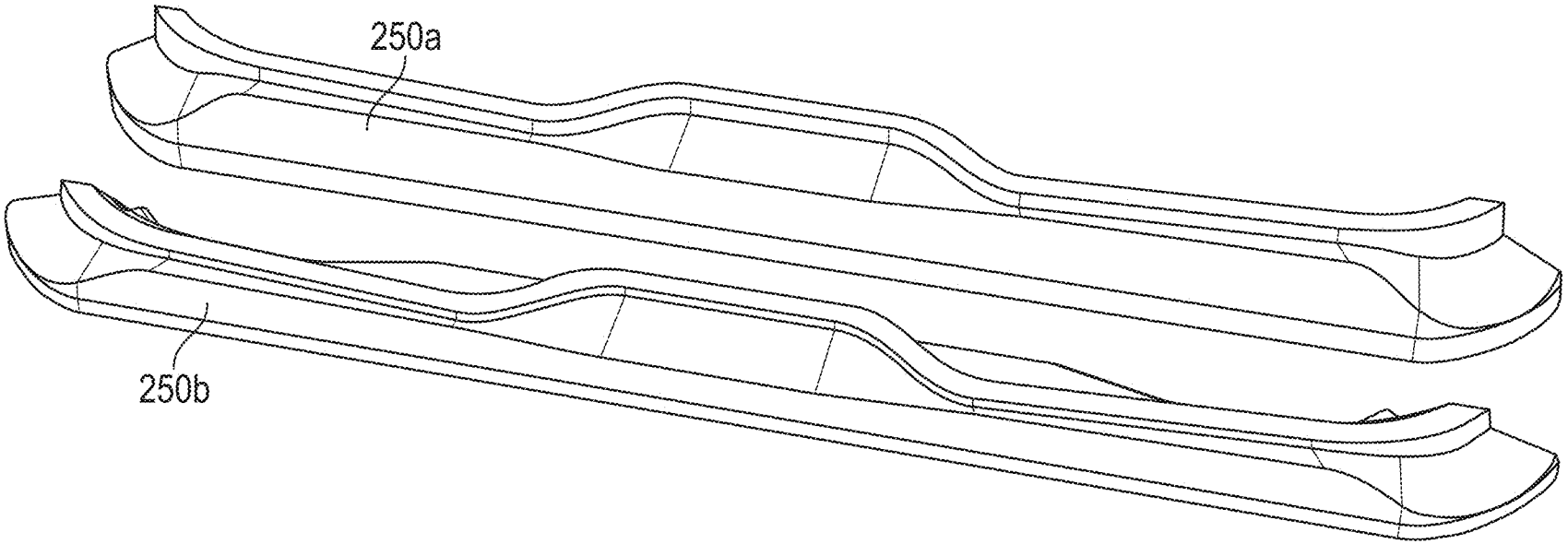
FIG. 10B shows the shells trims shown in FIG. 10A.

As shown in FIGS. 10A and 10B, the spa frame 200 can receive and secure shell trims of different sizes. For example, a shell trim 250*a* can have a height H1 larger than the height H2 of a shell trim 250*b*. In some cases, height H1 is larger than H2 by or about 3 in. Securing shell trims of different sizes can beneficially allow the spa frame 200 to adjust its overall height. For example, the dimensions of the shell trims can cause the height of the spa frame 200 to be between about 33 in. to about 36 in.

Although certain embodiments and examples are disclosed herein, inventive subject matter extends beyond the examples in the specifically disclosed embodiments to other alternative embodiments and/or uses, and to modifications and equivalents thereof. While we have described and illustrated in detail embodiments of a spa frame that includes a frame member and a sliding member, it should be understood that our inventions can be modified in both arrangement and detail. Thus, the scope of the claims appended hereto is not limited by any of the particular embodiments described above. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without other input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount.

Although the spa frame has been disclosed in the context of certain embodiments and examples, it will be understood by those skilled in the art that the spa frame and subassemblies extend beyond the specifically disclosed embodiments to other alternative embodiments and/or uses of the embodiments and certain modifications and equivalents thereof. Accordingly, it is intended that the scope of the spa frame herein-disclosed should not be limited by the particular disclosed embodiments described above but should be determined only by a fair reading of the claims that follow.

ADDITIONAL EMBODIMENTS

A spa frame configured to receive a spa shell, the spa frame comprising:

- a first plurality of longitudinal support structures having a top end and a bottom end;
- a second plurality of horizontal support structures attached to the top ends of the first plurality of support structures;
- a third plurality of horizontal support structures attached to the bottom ends of the first plurality of support structures;
- a base attached to the third plurality of support structures;
- a plurality of openings formed by the first, second, and third plurality of support structures;
- a first plurality of panels attached to the plurality of openings on a first side of the spa frame; and
- a second plurality of panels attached to a second side of the spa frame, the second plurality of panels comprising a different shape and/or different material from the plurality of panels.

A spa frame as described in any embodiment herein, wherein a shape of the first plurality of panels corresponds to a shape of the plurality of openings on the first side.

A spa frame as described in any embodiment herein, wherein a length of the second plurality of panels corresponds to a length of the spa frame.

What is claimed is:

1. An adjustable spa frame for a spa unit, the adjustable spa frame comprising:

- a frame member configured to interface with a sliding frame, the sliding frame forming at least a portion of a sidewall of the adjustable spa frame, the sliding frame configured to be adjusted relative to the frame member to secure the sliding frame at a first position or a second position relative to the frame member; and
- a second frame member configured to interface with a second sliding frame, wherein the second frame member is configured to be non-adjustably secured to the sliding frame;
- wherein the sidewall of the adjustable spa frame has a first length when the sliding frame is in the first position; and
- wherein the sidewall of the adjustable spa frame has a second length different than the first length when the sliding frame is in the second position.

2. The adjustable spa frame of claim 1, wherein the sliding frame is configured to slide relative to the frame member.

3. The adjustable spa frame of claim 1, wherein the frame member is configured to receive the sliding frame.

4. The adjustable spa frame of claim 1 , wherein the second sliding frame is arranged perpendicular to the sliding frame.

5. The adjustable spa frame of claim 1, wherein the frame member forms a corner of the adjustable spa frame.

6. The adjustable spa frame of claim 1, wherein the frame member comprises a top rail and a bottom rail, the top rail configured to receive a top arm of the sliding frame and the bottom rail configured to receive a bottom arm of the sliding frame.

7. The adjustable spa frame of claim 1, wherein the sliding frame is configured to be secured to the frame member at a third position.

8. An adjustable spa frame configured to receive a spa shell, the adjustable spa frame comprising:

- a plurality of frame members, each frame of the plurality of frame members comprising:
  - a top rail,
  - a bottom rail,
- a plurality of sliding frames, each of the plurality of sliding frames comprising:
  - a top arm,
  - a bottom arm,
- wherein the top rail of each of the plurality of frame members is configured to receive the top arm of one of the plurality of sliding frames, and the bottom rail of each of the plurality of frame members is configured to receive the bottom arm of one of the plurality of sliding frames; and
- wherein a length of one frame member and one sliding frame when the one frame member and the one sliding frame are secured to each other is configured to be adjusted by sliding the one sliding frame from a first position to a second position.

9. The adjustable spa frame of claim 8, wherein the length of the one frame member and the one sliding frame is adjustable by at least 10 inches.

10. The adjustable spa frame of claim 8, further comprising a plurality of bumpers configured to be removably connected to the plurality of frame members, the plurality of bumpers forming rounded corners of the spa frame.

11. The adjustable spa frame of claim 8, wherein the plurality of frame members further comprises a plurality of openings including a first opening and a second opening in the top rail or the bottom rail.

12. The adjustable spa frame of claim 11, wherein the plurality of sliding frames further comprises a push button configured to secure one of the plurality of sliding frames to one of the plurality of frame members by at least partially extending through at least one of the first and second openings.

13. The adjustable spa frame of claim 8, wherein the plurality of frame members further comprises a plurality of visual markers including a first visual marker and a second visual marker.

14. The adjustable spa frame of claim 13, wherein the plurality of visual markers are located adjacent to a plurality of openings of the plurality of frame members and provide an indication of the length of the one frame member and the one sliding frame when the one frame member and the one sliding frame are secured to each other.

15. The adjustable spa frame of claim 8, wherein the plurality of frame members and the plurality of sliding frames form a quadrilateral shape when the plurality of frame members are secured to the plurality of sliding frames.

16. The adjustable spa frame of claim 8, further comprising a kick rail positioned on a ground facing area of the spa frame, the kick rail configured to secure to at least one of a shallow pan and a deep pan.

17. The adjustable spa frame of claim 8, wherein a top edge of the spa frame is configured to receive and secure a shell trim.

18. An adjustable spa frame for a spa unit, the adjustable spa frame comprising:

a frame member configured to interface with a sliding frame, the sliding frame forming at least a portion of a sidewall of the adjustable spa frame, the sliding frame configured to be adjusted relative to the frame member to secure the sliding frame at a first position or a second position relative to the frame member; and a second frame member configured to interface with a second sliding frame, wherein the second sliding frame is arranged perpendicular to the sliding frame;

wherein the sidewall of the adjustable spa frame has a first length when the sliding frame is in the first position; and wherein the sidewall of the adjustable spa frame has a second length different than the first length when the sliding frame is in the second position.

19. The adjustable spa frame of claim 18, wherein the sliding frame is configured to slide relative to the frame member.

20. The adjustable spa frame of claim 18, wherein the frame member is configured to receive the sliding frame.

* * * * *